US009761191B2

(12) United States Patent
Xu et al.

(10) Patent No.: US 9,761,191 B2
(45) Date of Patent: Sep. 12, 2017

(54) METHOD FOR DRIVING DISPLAY APPARATUS AND DISPLAY APPARATUS

(71) Applicants: BOE TECHNOLOGY GROUP CO., LTD., Beijing (CN); Chongqing BOE Optoelectronics Technology CO., Ltd., Chongqing (CN)

(72) Inventors: Yizhen Xu, Beijing (CN); Zhizhong Tu, Beijing (CN); Fei Shang, Beijing (CN); Haijun Qiu, Beijing (CN)

(73) Assignees: BOE TECHNOLOGY GROUP CO., LTD., Beijing (CN); CHONGQING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 11 days.

(21) Appl. No.: 14/800,541

(22) Filed: Jul. 15, 2015

(65) Prior Publication Data

US 2016/0118004 A1 Apr. 28, 2016

(30) Foreign Application Priority Data

Oct. 22, 2014 (CN) ..... 2014 1 0565793

(51) Int. Cl.
*G09G 3/36* (2006.01)
*G09G 3/3266* (2016.01)
*G09G 3/3291* (2016.01)

(52) U.S. Cl.
CPC ..... *G09G 3/3648* (2013.01); *G09G 3/3266* (2013.01); *G09G 3/3291* (2013.01);
(Continued)

(58) Field of Classification Search
CPC ..... G09G 3/3648; G09G 2300/0426; G09G 2300/0828; G09G 2310/0291;
(Continued)

(56) References Cited

U.S. PATENT DOCUMENTS 5,473,223 A * 12/1995 Murakami ..... H04N 3/2335 315/367
5,537,650 A 7/1996 West et al.
(Continued)

FOREIGN PATENT DOCUMENTS

CN 202749073 U 2/2013

OTHER PUBLICATIONS

First Chinese Office Action including English translation issued Feb. 3, 2016, received for corresponding Chinese Application No. 201410565793.1.

*Primary Examiner* — Amare Mengistu
*Assistant Examiner* — Jennifer Zubajlo
(74) *Attorney, Agent, or Firm* — Kinney & Lange, P.A.

(57) ABSTRACT

A method for driving a display apparatus and a display apparatus are provided. With the method for driving a display apparatus according to the present disclosure, the gate driver circuit, the source driver circuit and the reference voltage generation circuit are controlled not to output any signal during an interval between display of two frames of pictures, so as to solve the problems that a gate driver circuit and a source driver circuit in the existing display apparatus have large power consumption, and operate at an excessive high temperature.

12 Claims, 5 Drawing Sheets

(52) U.S. Cl.
CPC ..... *G09G 2300/0426* (2013.01); *G09G 2310/0289* (2013.01); *G09G 2310/0291* (2013.01); *G09G 2330/022* (2013.01)

(58) Field of Classification Search
CPC ..... G09G 2330/022; G09G 2330/023; G09G 3/3266; G09G 3/3291
See application file for complete search history.

(56) References Cited

U.S. PATENT DOCUMENTS

| | | | | |
|---|---|---|---|---|
| 5,550,885 | A * | 8/1996 | Nam | G06F 1/3218 327/544 |
| 5,926,173 | A * | 7/1999 | Moon | G09G 3/3611 345/211 |
| 6,677,937 | B1 | 1/2004 | Takahashi et al. | |
| 2004/0160408 | A1 | 8/2004 | Hwang | |
| 2005/0184934 | A1 * | 8/2005 | Kim | G09G 3/3233 345/76 |
| 2007/0279528 | A1 * | 12/2007 | Tokoshima | H04N 5/44591 348/588 |
| 2011/0205206 | A1 * | 8/2011 | Yoo | G09G 3/3275 345/211 |

* cited by examiner

METHOD FOR DRIVING DISPLAY APPARATUS AND DISPLAY APPARATUS

TECHNICAL FIELD

The present disclosure relates to the field of display, and in particular, to a method for driving a display apparatus and a display apparatus.

BACKGROUND

Thin Film Transistor Liquid Crystal Displays (TFT LCDs) are currently the only display devices which exceed Cathode Ray Tubes (CRTs) in comprehensive performance such as brightness, contrast, power consumption, lifetime, volume, and weight or the like, and have become mainstream products in the field of display.

a TFT LCD generally comprises a liquid crystal display panel, a gate driver circuit (or a gate driver Integrated Chip (IC)) and a source driver circuit (or a source driver IC). The liquid crystal display panel comprises a color film substrate and a TFT array substrate which are set for cells, and a liquid crystal layer placed between the above substrates. Data lines and gate lines are arranged on the TFT array substrate in a crisscross pattern. The data lines and the gate lines divide the whole liquid crystal display panel into a plurality of pixel regions, and a TFT is designed for each pixel region on the TFT array substrate. A data line is connected to a source of a TFT, and a gate line is connected to a gate of the TFT. Various TFTs are distributed on the substrate in an array pattern. When the TFT LCDs operate, various independent pixel regions on the screen are controlled by these TFTs as follows.

For each frame of picture, gate scanning signals are applied by the gate driver circuit to gates of TFTs via gate lines to control various rows of TFTs to start in succession. Display data signals are output by the source driver circuit to drains of the TFTs via data lines, and when a certain row of TFTs are started, a corresponding display data signal is applied by the source driver circuit to a pixel electrode of a row of pixels corresponding to the row of TFTs, so as to display a frame of image.

The existing gate driver circuit and source driver circuit have large power consumption, and operate at an excessive high temperature, which brings adverse effects to the lifetime of the circuit per se while wasting energy.

SUMMARY

The embodiments of the present disclosure provide a method for driving a display apparatus and a display apparatus, which can solve the problems that a gate driver circuit and a source driver circuit in the existing display apparatus have large power consumption, and operate at an excessive high temperature.

A method for driving a display apparatus comprises:

controlling a gate driver circuit, a source driver circuit, and a reference voltage generation circuit not to output any signal during an interval between display of two frames of pictures.

Preferably, the gate driver circuit, the source driver circuit and the reference voltage generation circuit are controlled by a vertical synchronous signal not to output any signal during the interval between display of two frames of pictures.

Preferably, controlling the gate driver circuit, the source driver circuit and the reference voltage generation circuit by the vertical synchronous signal not to output any signal during the interval between display of two frames of pictures further comprises:

controlling the gate driver circuit, the source driver circuit and the reference voltage generation circuit to normally output a signal during an active time period of the vertical synchronous signal; and controlling the gate driver circuit, the source driver circuit and the reference voltage generation circuit to stop outputting a signal during a blanking time period of the vertical synchronous signal.

The present disclosure further provides a display apparatus, comprising a gate driver circuit, a source driver circuit, and a reference voltage generation circuit, wherein, the gate driver circuit, the source driver circuit and the reference voltage generation circuit are controlled not to output any signal during an interval between display of two frames of pictures.

Preferably, a first thin film transistor is connected on an output path of the source driver circuit, and a vertical synchronous signal is input into a control electrode of the first thin film transistor.

Preferably, the output path of the source driver circuit comprises a digital-to-analog converter and an output buffer, the first thin film transistor is connected between the digital-to-analog converter and the output buffer, and the first thin film transistor has a first electrode connected to an output end of the digital-to-analog converter and a second electrode connected to an input end of the output buffer.

Preferably, a second thin film transistor is connected on an output path of the gate driver circuit, and a vertical synchronous signal is input into a control electrode of the second thin film transistor.

Preferably, the output path of the gate driver circuit comprises a gate signal logic level generation circuit part and a level shifter, and the second thin film transistor has a first electrode connected to an output end of the gate signal logic level generation circuit part and a second electrode connected to a digital signal input end of the level shifter.

Preferably, a third thin film transistor is connected on an output path of the reference voltage generation circuit, and a vertical synchronous signal is input into a control electrode of the third thin film transistor.

Preferably, an output path of the reference voltage generation circuit comprises a reference voltage generation circuit part and an amplification circuit part, and the third thin film transistor has a first electrode connected to an output end of the reference voltage generation circuit part and a second electrode connected to an input end of the amplification circuit part.

Preferably, the display apparatus further comprises: a timing controller having a vertical synchronous signal output end connected to the control electrode of the first thin film transistor.

Preferably, the display apparatus further comprises: a timing controller having a vertical synchronous signal output end connected to the control electrode of the second thin film transistor.

Preferably, the display apparatus further comprises: a timing controller having a vertical synchronous signal output end connected to the control electrode of the third thin film transistor.

The embodiments of the present disclosure provide a method for driving a display apparatus and a display apparatus, which control a gate driver circuit, a source driver circuit and a reference voltage generation circuit not to output any signal during an interval between display of two frames of pictures, so as to solve the problems that a gate driver circuit and a source driver circuit in the existing display apparatus have large power consumption, and operate at an excessive high temperature.

BRIEF DESCRIPTION OF THE DRAWINGS

Next, the accompanying drawings used in the embodiments will be described briefly in order to more clearly describe the technical solutions in the embodiments of the present disclosure. Obviously, the accompanying drawings described below are merely some embodiments recited in the present disclosure. Other embodiments will be readily apparent to those skilled in the art in light of these accompanying drawings without contributing any creative labor.

REFERENCE SIGNS

11—source driver circuit, 12—gate driver circuit, 13—reference voltage generation circuit,

14—timing controller, 15—display panel, 16—PCBA panel, 111—digital-to-analog converter,

112—output buffer, 121—level shifter, 122—output buffer,

131—reference voltage generation circuit part, 132—amplification circuit part,

21—first thin film transistor, 22—second thin film transistor, 23—third thin film transistor.

DETAILED DESCRIPTION

The technical solutions in the embodiments of the present disclosure will be described clearly and completely below in conjunction with accompanying drawings of the present disclosure. Obviously, the embodiments described herein are merely some of the embodiments of the present disclosure instead of all of the embodiments.

The embodiments of the present disclosure provide a method for driving a display apparatus, which controls a gate driver circuit, a source driver circuit and a reference voltage generation circuit not to output any signal during an interval between display of two frames of pictures, so as to achieve the purposes of reducing power consumption of the display apparatus and extending the usage time of the battery, and at the same time solve the problems that a gate driver circuit and a source driver circuit in the existing display apparatus have large power consumption, and operate at an excessive high temperature.

Those skilled in the art should understand that there are a plurality of specific implementations of controlling a gate driver circuit, a source driver circuit, and a reference voltage generation circuit not to output any signal during an interval between display of two frames of pictures and normally output a signal during the remaining time, which are not limited by the present embodiment and can be flexibly designed by those skilled in the art according to practical conditions. The present disclosure will be described below by taking a specific implementation as an example.

Figure 1:
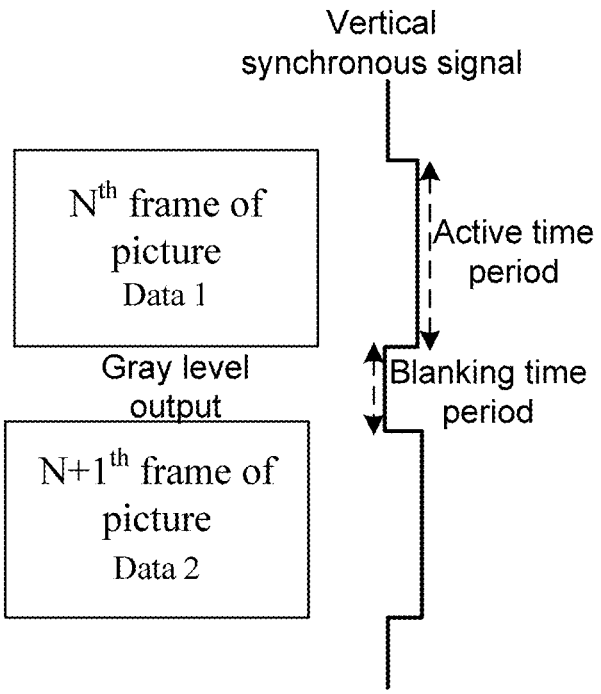
FIG. 1 is a diagram of an existing display apparatus outputting a gray level picture during an interval between two frames of pictures.

A vertical synchronous signal is a common signal in the field of display, and is used to control a duration of a frame of picture. The vertical synchronous signal has an active time period with a length corresponding to a length of data of a frame of picture, and has a blanking time period with a length corresponding to an interval between two frames of pictures. As shown in FIG. 1, the existing TFT LCDs output a gray level picture to charge the pictures during the blanking time period of the vertical synchronous signal.

Figure 2:
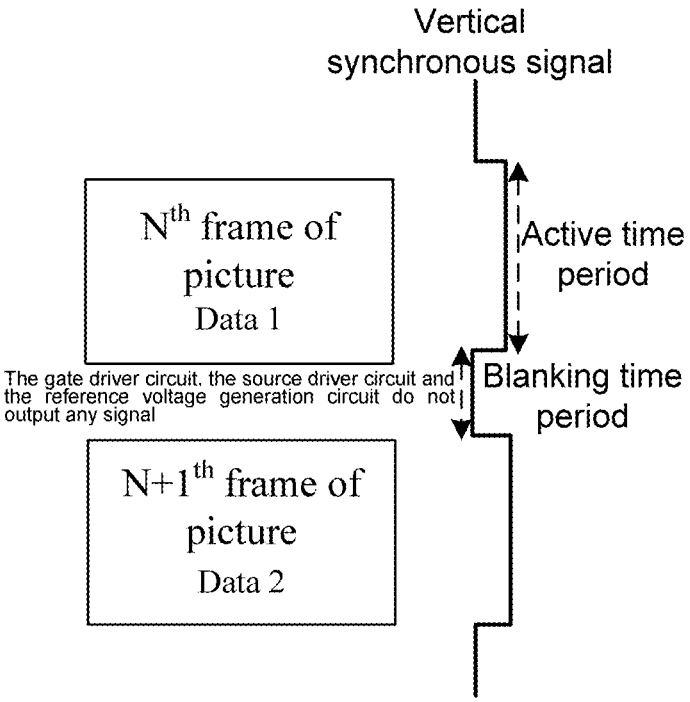
FIG. 2 is a schematic diagram of a method for driving a display apparatus according to an embodiment of the present disclosure.

On the basis of this, the inventor proposes to control the gate driver circuit, the source driver circuit, and the reference voltage generation circuit described above by using a vertical synchronous signal not to output any signal during an interval between two frames of pictures (i.e., the blanking time period of the vertical synchronous signal). Specifically, as shown in FIG. 2, the gate driver circuit, the source driver circuit and the reference voltage generation circuit normally output a signal during the active time period of the vertical synchronous signal, and stop outputting a signal during the blanking time period of the vertical synchronous signal.

In the present embodiment, the gate driver circuit, the source driver circuit and the reference voltage generation circuit are controlled by the existing vertical synchronous signal to stop outputting a signal during the blanking time period of the vertical synchronous signal, so as to achieve the purposes of reducing power consumption of the display apparatus and extending the usage time of the battery, and at the same time solve the problems that a gate driver circuit and a source driver circuit in the existing display apparatus have large power consumption, and operate at an excessive high temperature.

The above vertical synchronous signal may use a vertical synchronous signal (V sync) line of a Timing Controller (TCON) to control the gate driver circuit (or a gate driver IC) and the source driver circuit (or a source driver IC) and the reference voltage generation circuit not to output any signal during the blanking time period of the vertical synchronous signal.

To enable those skilled in the art to better understand the technical solutions according to the embodiments of the present disclosure, the display apparatus and the driving method thereof according to the present disclosure will be described in detail below through specific embodiments.

Figure 3:
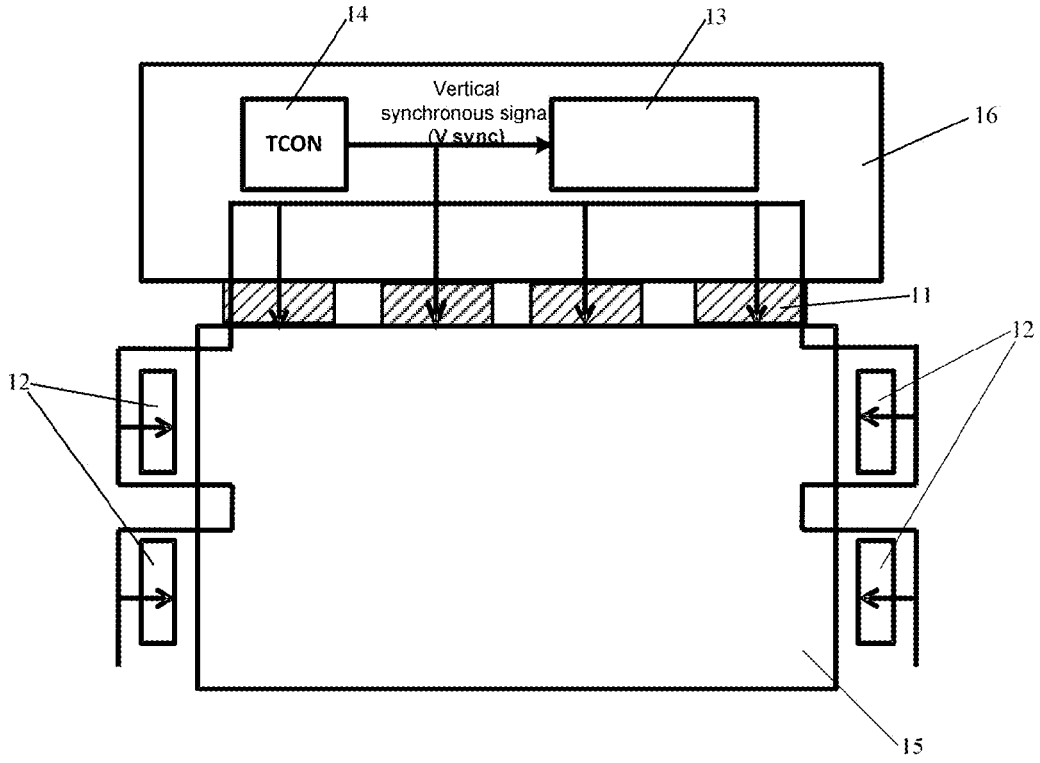
FIG. 3 is a structural diagram of a display apparatus according to an embodiment of the present disclosure.

As shown in FIG. 3, the display apparatus according to the embodiments of the present disclosure comprises a display panel 15, a source driver circuit 11, a gate driver circuit 12 and a reference voltage generation circuit 13. The gate driver circuit 12 is arranged on edges on two sides of the display panel 15, the source driver circuit 11 is connected to a data lead region on the edge of the display panel 15 through a flexible circuit panel (not shown), and the reference voltage generation circuit 13 is arranged on a Printed Circuit Board Assembly (PCBA) panel. A timing controller 14 is also arranged on the PCBA panel, and is used to generate a control signal for controlling the source driver circuit 11 and a control signal for controlling the gate driver circuit 12 according to an input synchronous signal. The synchronous signal comprises a horizontal synchronous signal, a vertical synchronous signal, and a Data Enable (DE for short) signal.

The vertical synchronous signal from the timing controller 14 is input into the source driver circuit 11, the gate driver circuit 12 and the reference voltage generation circuit 13 respectively, to control these circuits not to output any signal during the blanking time period of the vertical synchronous signal, and normally output a signal during the remaining time (i.e., active time period).

Specifically, in the present embodiment, a first thin film transistor 21 is also connected on an output path of the source driver circuit 11, and the vertical synchronous signal is input into a control electrode of the first thin film transistor 21. A position of the first thin film transistor 21 on the output path of the source driver circuit 11 may be flexibly designed, as long as the purpose of controlling the output of a display data signal is achieved.

Figure 4:
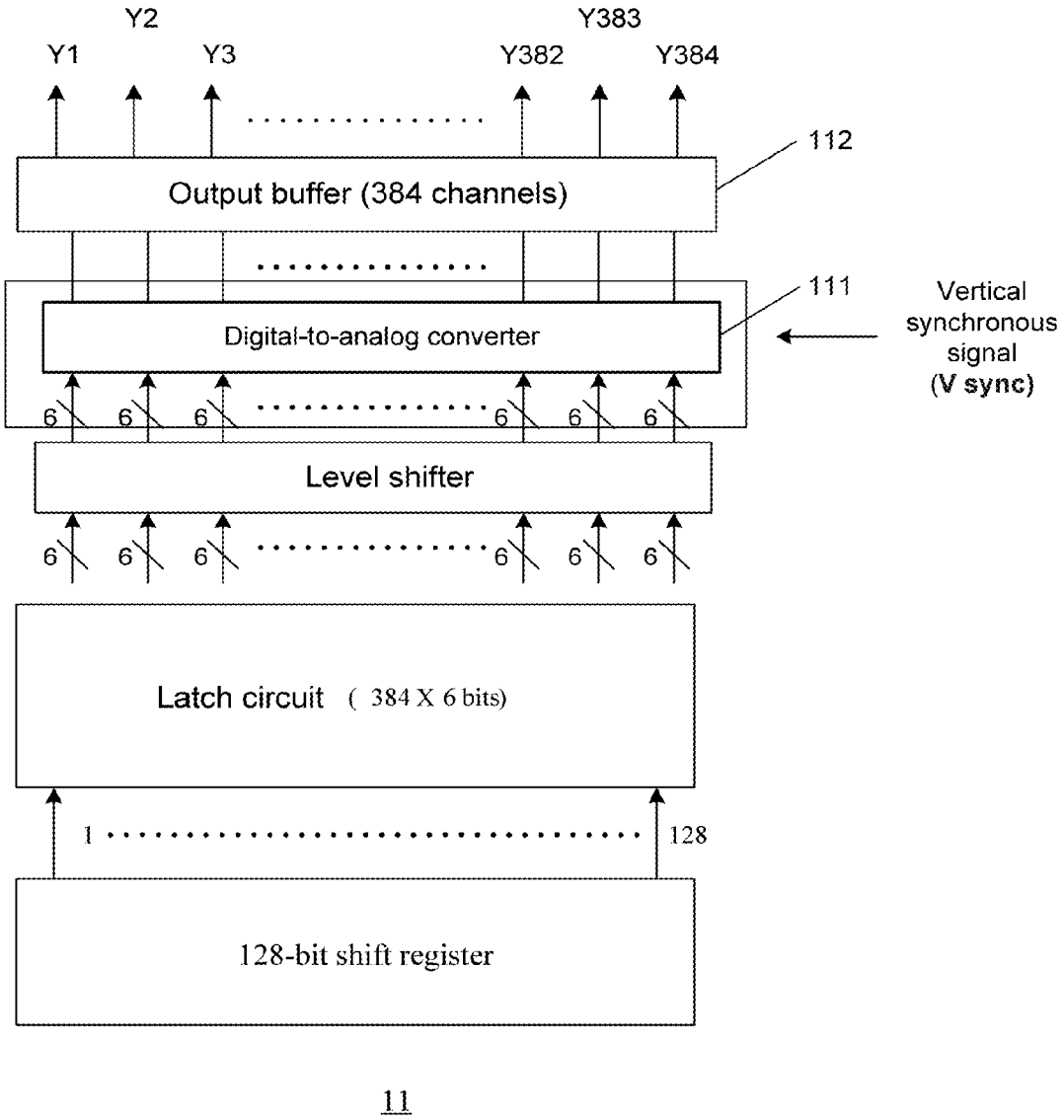
FIG. 4 is a structural diagram of a source driver circuit according to an embodiment of the present disclosure.
Figure 5:
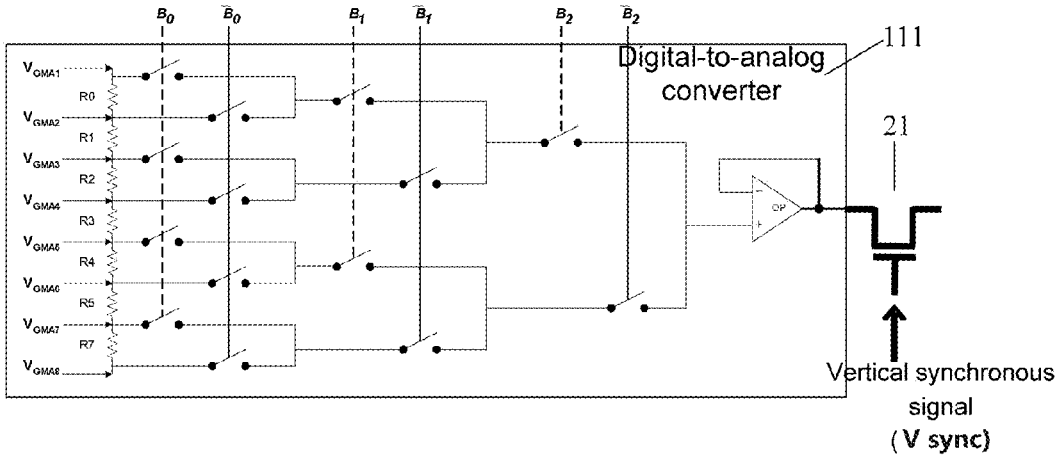
FIG. 5 is a partial enlarged view of FIG. 4.

An optional specific solution is shown in FIGS. 4 and 5. FIG. 4 is a structural diagram of the source driver circuit 11 according to the present embodiment, and FIG. 5 is a partial enlarged view of FIG. 4. An output path of the source driver circuit 11 comprises a digital-to-analog converter 111 and an output buffer 112. A first thin film transistor 21 is connected between the digital-to-analog converter 111 and the output buffer 112. The first thin film transistor 21 has a first electrode connected to an output end of the digital-to-analog converter 111, a second electrode connected to an input end of the output buffer 112, and a control electrode connected to a vertical synchronous signal output end of a timing controller 14. During an active time period (corresponding to a high level) of the vertical synchronous signal, the first thin film transistor 21 is turned on, and the source driver circuit 11 normally outputs a data display signal. During a blanking time period (corresponding to a low level) of the vertical synchronous signal, the first thin film transistor 21 is turned off, and the source driver circuit 11 does not output any signal.

Figure 6:
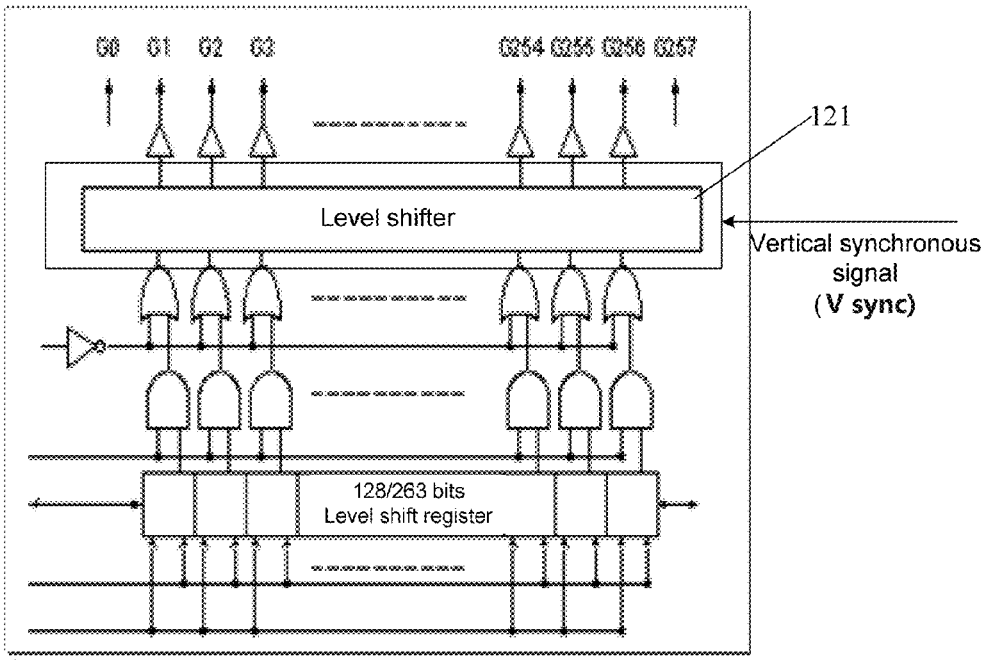
FIG. 6 is a structural diagram of a gate driver circuit according to an embodiment of the present disclosure.
Figure 7:
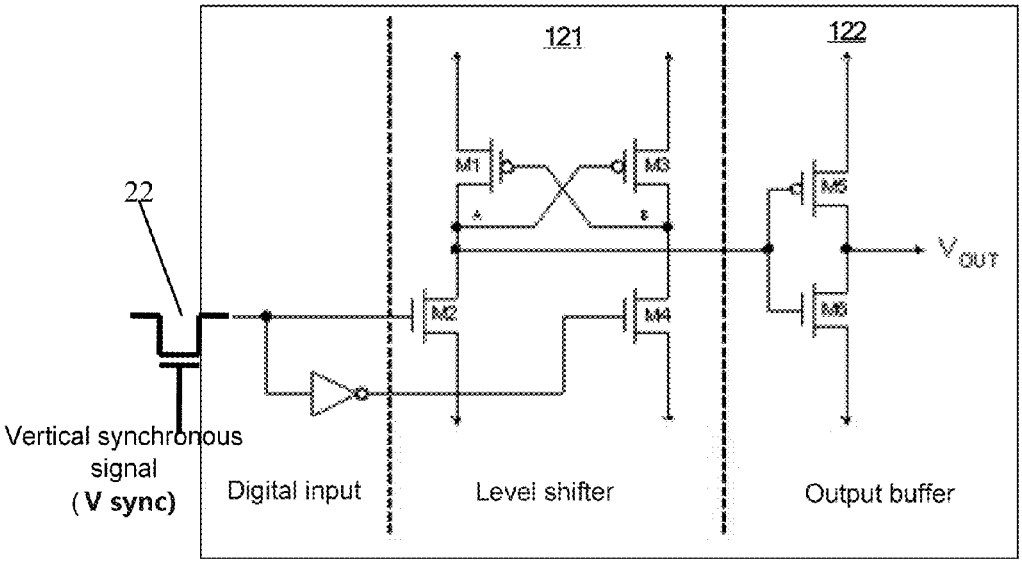
FIG. 7 is a partial enlarged view of FIG. 6.
Figure 8:
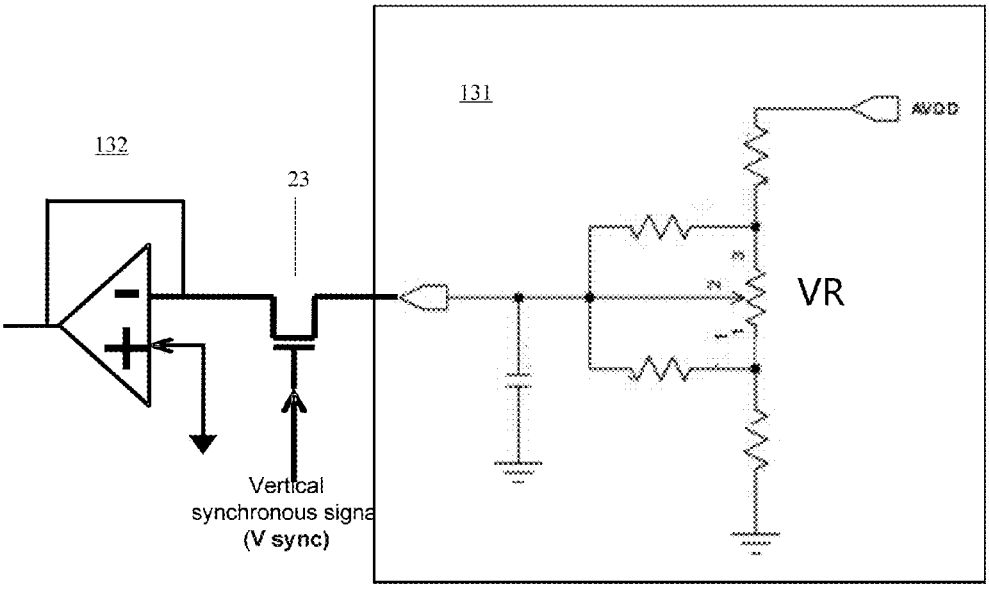
FIG. 8 is a partial enlarged view of a reference voltage generation circuit according to an embodiment of the present disclosure.

Similarly, as shown in FIGS. 6 and 7, the second thin film transistor 22 is also connected on an output path of a gate driver circuit 12, and a vertical synchronous signal is input into a control electrode of the second thin film transistor 22. Specifically, the output path of the gate driver circuit 12 comprises a gate signal logic level generation circuit part and a level shifter 121. The second thin film transistor 22 has a first electrode connected to an output end of the gate signal logic level generation circuit part, and a second electrode connected to a digital signal input end of the level shifter 121. An output end of the level shifter 121 is connected to the output buffer 122, and an output end ($V_{OUT}$) of the output buffer 121 is correspondingly connected to various gate lines on the display panel 15. During an active time period of the vertical synchronous signal, the second thin film transistor 21 is turned on, and the gate driver circuit 12 normally outputs a data display signal. During a blanking time period of the vertical synchronous signal, the second thin film transistor 22 is turned off, and the gate driver circuit 12 does not output any signal.

Similarly, as shown in FIGS. 6 and 7, the third thin film transistor 23 is also connected on an output path of a reference voltage generation circuit 13, and a vertical synchronous signal is input into a control electrode of the third thin film transistor 23. Optionally, the output path of the reference voltage generation circuit 13 comprises a reference voltage generation circuit part (partially shown) and an amplification circuit part 132. The third thin film transistor 23 has a first electrode connected to an output end of the reference voltage generation circuit part 131, and a second electrode connected to an input end of the amplification circuit part 132. During an active time period of the vertical synchronous signal, the third thin film transistor 23 is turned on, and the reference voltage generation circuit 13 normally outputs a data display signal. During a blanking time period of the vertical synchronous signal, the third thin film transistor 23 is turned off, and the reference voltage generation circuit 13 does not output any signal.

The source driver circuit 11, the gate driver circuit 12 and the reference voltage generation circuit 13 described above are merely related to some structures related to the present disclosure. The more specific structure may be known with reference to the related art, and will not be described herein.

In addition, a control electrode of any of the first thin film transistor 21, the second thin film transistor 22, and the third thin film transistor 23 is connected to the vertical synchronous signal output end of the timing controller 14. Positions of various thin film transistors on various output paths may be flexibly designed, as long as the purpose of controlling output of a signal is achieved.

The embodiments of the present disclosure provide a method for driving a display apparatus and a display apparatus, which control a gate driver circuit, a source driver circuit and a reference voltage generation circuit not to output any signal during an interval between display of two frames of pictures, so as to solve the problems that a gate driver circuit and a source driver circuit in the existing display apparatus have large power consumption, and operate at an excessive high temperature. The display apparatus achieves power saving, and may be any product or component having a display function such as a liquid crystal panel, an electronic paper, a mobile phone, a tablet, a television, a display, a notebook computer, a digital photo frame, a navigator or the like.

For convenience of clear illustration, in the present disclosure, words "first" and "second" or the like are used to distinguish similar items. The words "first" and "second" are not used to limit the present disclosure in terms of numbers, and is an example of a preferable manner. Similar variations or related extensions which are easily envisaged by those skilled in the art according to the content of the present disclosure should belong to the protection scope of the present disclosure.

Various embodiments of the specification are described in a progressive manner. The same or similar parts between various embodiments can be known with reference to each other, and each embodiment focuses on differences from other embodiments. In particular, as device embodiments are substantially similar to method embodiments, the device embodiments are described in brief, and the related parts of the device embodiments can be known with reference to corresponding parts of the method embodiments.

An ordinary skilled in the art should understand that all or a part of flows in the above method embodiments can be implemented by computer programs instructing related hardware. The programs may be stored in a computer readable storage medium. When the programs are implemented, the flows of the various method embodiments described above may be included. The storage medium may be a disk, a disc, a Read-Only Memory (ROM) or a Random Access Memory (RAM) or the like.

The above description is merely specific embodiments of the present disclosure, but the protection scope of the present disclosure is not limited thereto. Changes or substitutions, which can be obviously envisaged by those skilled persons in the art within the technical scope of the present disclosure, should be included in the scope of the present disclosure. Therefore, the protection scope of the present disclosure should be defined by the protection scope of the claims.

We claim:

1. A method for driving a display apparatus, comprising:

controlling a gate driver circuit, a source driver circuit, and a reference voltage generation circuit not to output any signal during an interval between display of two frames of pictures;

wherein the gate driver circuit, the source driver circuit and the reference voltage generation circuit are controlled by a vertical synchronous signal which is directly input to a first thin film transistor connected on an output path for the source driver circuit, a second thin film transistor connected on an output path of the gate driver circuit, and a third thin film transistor connected on an output path of the reference voltage generation circuit respectively not to output any signal during the interval between display of two frames of pictures.

2. The method according to claim 1, wherein controlling the gate driver circuit, the source driver circuit and the reference voltage generation circuit by the vertical synchronous signal not to output any signal during the interval between display of two frames of pictures further comprises:

controlling the gate driver circuit, the source driver circuit and the reference voltage generation circuit to normally output a signal during an active time period of the vertical synchronous signal; and controlling the gate driver circuit, the source driver circuit and the reference voltage generation circuit to stop outputting a signal during a blanking time period of the vertical synchronous signal.

3. A display apparatus, comprising a gate driver circuit, a source driver circuit, and a reference voltage generation circuit, wherein, the gate driver circuit, the source driver circuit and the reference voltage generation circuit are controlled by a vertical synchronous signal which is directly input to a first thin film transistor connected on an output path for the source driver circuit, a second thin film transistor connected on an output path of the gate driver circuit, a third thin film transistor connected on an output path of the reference voltage generation circuit respectively not to output any signal during an interval between display of two frames of pictures.

4. The display apparatus according to claim 3, wherein the vertical synchronous signal is input into a control electrode of the first thin film transistor.

5. The display apparatus according to claim 4, wherein the output path of the source driver circuit comprises a digital-to-analog converter and an output buffer, the first thin film transistor is connected between the digital-to-analog converter and the output buffer, and the first thin film transistor has a first electrode connected to an output end of the digital-to-analog converter and a second electrode connected to an input end of the output buffer.

6. The display apparatus according to claim 4, further comprising: a timing controller having a vertical synchronous signal output end connected to the control electrode of the first thin film transistor.

7. The display apparatus according to claim 3, wherein the vertical synchronous signal is input into a control electrode of the second thin film transistor.

8. The display apparatus according to claim 7, wherein the output path of the gate driver circuit comprises a gate signal logic level generation circuit part and a level shifter, and the second thin film transistor has a first electrode connected to an output end of the gate signal logic level generation circuit part and a second electrode connected to a digital signal input end of the level shifter.

9. The display apparatus according to claim 7, further comprising: a timing controller having a vertical synchronous signal output end connected to the control electrode of the second thin film transistor.

10. The display apparatus according to claim 3, wherein the vertical synchronous signal is input into a control electrode of the third thin film transistor.

11. The display apparatus according to claim 10, wherein an output path of the reference voltage generation circuit comprises a reference voltage generation circuit part and an amplification circuit part, and the third thin film transistor has a first electrode connected to an output end of the reference voltage generation circuit part and a second electrode connected to an input end of the amplification circuit part.

12. The display apparatus according to claim 10, further comprising: a timing controller having a vertical synchronous signal output end connected to the control electrode of the third thin film transistor.

* * * * *